US008505686B2

(12) United States Patent
Parker

(10) Patent No.: US 8,505,686 B2
(45) **Date of Patent: *Aug. 13, 2013**

(54) PUMP JACK CRANK

(75) Inventor: Thomas W. Parker, Jamestown, PA (US)

(73) Assignee: Werner Co., Greenville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/931,588

(22) Filed: Feb. 5, 2011

(65) Prior Publication Data

US 2011/0132132 A1 Jun. 9, 2011

Related U.S. Application Data

(62) Division of application No. 11/122,360, filed on May 5, 2005, now Pat. No. 7,882,930.

(60) Provisional application No. 60/570,618, filed on May 12, 2004.

(51) Int. Cl.
*E04G 1/18* (2006.01)

(52) U.S. Cl.
USPC ..... 182/82; 403/150; 403/157; 403/364; 182/146

(58) Field of Classification Search
USPC ..... 403/150, 157, 364; 182/82, 146
See application file for complete search history.

(56) References Cited

U.S. PATENT DOCUMENTS

| | | | | | |
|---|---|---|---|---|---|
| 4,078,633 | A * | 3/1978 | Fahy | 182/82 |
| 4,432,435 | A * | 2/1984 | Anderson | 182/82 |
| 4,463,828 | A * | 8/1984 | Anderson | 182/136 |
| 4,666,131 | A * | 5/1987 | Kettelkamp et al. | 256/59 |
| 4,955,584 | A * | 9/1990 | Anderson | 182/133 |
| 5,307,899 | A * | 5/1994 | Lubinski | 182/136 |
| 5,975,241 | A * | 11/1999 | Berish et al. | 182/136 |
| 6,015,028 | A * | 1/2000 | Smith | 182/136 |
| 6,550,188 | B2 * | 4/2003 | Bolinger et al. | 52/127.2 |
| 7,228,937 | B2 * | 6/2007 | Morris | 182/82 |
| 2003/0233858 | A1 * | 12/2003 | Saladin et al. | 70/212 |

* cited by examiner

*Primary Examiner* — Katherine Mitchell
*Assistant Examiner* — Candace L Bradford
(74) *Attorney, Agent, or Firm* — Ansel M. Schwartz

(57) ABSTRACT

An apparatus for cranking a shackle of a pump jack. The apparatus includes a shaft which fits through the shackle. The apparatus includes an arm rotatably attached to the shaft The apparatus includes a handle for cranking the shaft. The handle having a locked state in which the handle is unable to rotate the shaft, and an unlocked state in which the handle is able to rotate the shaft. The handle attached to the arm. The apparatus includes a locking mechanism engaging the arm at a pivot point and the shaft, the locking mechanism placing the handle in the locked state or the unlocked state by moving the handle about the pivot point to a first position or a second position, respectively.

9 Claims, 5 Drawing Sheets

PUMP JACK CRANK

CROSS-REFERENCE

This is a divisional of U.S. patent application Ser. No. 11/122,360 filed May 5, 2005, now U.S. Pat. No. 7,882,930 issued Feb. 8, 2011, which is a non-provisional of U.S. patent application Ser. No. 60/570,618 filed May 12, 2004, which is also related to contemporaneously filed U.S. patent application Ser. No. 11/122,419 filed May 5, 2005, which is a non-provisional of U.S. patent application Ser. No. 60/570,647 filed May 12, 2004, all of which are incorporated by reference herein.

FIELD OF THE INVENTION

The present invention is related to a pump jack crank. More specifically, the present invention is related to a pump jack crank having a locking mechanism for placing the handle in a locked state or an unlocked state by moving the handle about the pivot point to a first position or a second position, respectively.

BACKGROUND OF THE INVENTION

A pump jack has an upper and lower shackle which act as friction ratchets to grip the pole tightly as the work platform is being raised and while in use. To lower the work platform, the lower shackle is released and the shaft of the upper shackle which directly grips the pole is rotated to lower the pump jack and work platform. It is very important that the shaft of the upper shackle is positively locked against rotation until the platform is to be lowered. Locking of the shaft should be easily done and its locked condition should be easily verified by the user.

One design presently in production depends upon the crank handle of the upper shackle shaft being jammed behind the pole for locking. This potentially can allow the platform to drop some distance before solid lock-up will occur. Another design requires that the user hold the shaft crank handle against axial spring force while cranking in order to disengage the lock on the shaft. Subsequent locking depends on the user returning the shaft crank handle to a specific position. Both of these designs are awkward to use or have the risk of not locking securely.

The present invention is a crank mechanism that overcomes these faults. It will lock securely and easily, and when unlocked will allow for easy cranking operation.

SUMMARY OF THE INVENTION

The present invention pertains to an apparatus for cranking a shackle of a pump jack. The apparatus comprises a shaft which fits through the shackle. The apparatus comprises an arm rotatably attached to the shaft in proximity to a first end of an arm. The apparatus comprises a handle for cranking the shaft. The handle having a locked state in which the handle is unable to rotate the shaft, and an unlocked state in which the handle is able to rotate the shaft. The handle attached to the arm in proximity to a second end of the arm. The handle extending essentially perpendicularly from the arm. The apparatus comprises a locking mechanism engaging the arm at a pivot point and the shaft. The locking mechanism placing the handle in the locked state or the unlocked state by moving the arm about the pivot point to a first position where the handle extends inward toward the shackle or a second position where the handle extends outward away from the shackle, respectively.

The present invention pertains to a method for cranking a shackle of a pump jack. The method comprises the steps of placing a handle for cranking a shaft that extends through the shackle in an unlocked state where the handle extends outward away from the shackle by moving the handle about a pivot point from a locked state where a locking mechanism engages an arm that extends from the shaft and the handle extends essentially perpendicularly from the arm and where the handle extends inward toward the shackle. There is the step of rotating the handle about an axis of the shaft to rotate the shaft.

DETAILED DESCRIPTION

Figure 1:
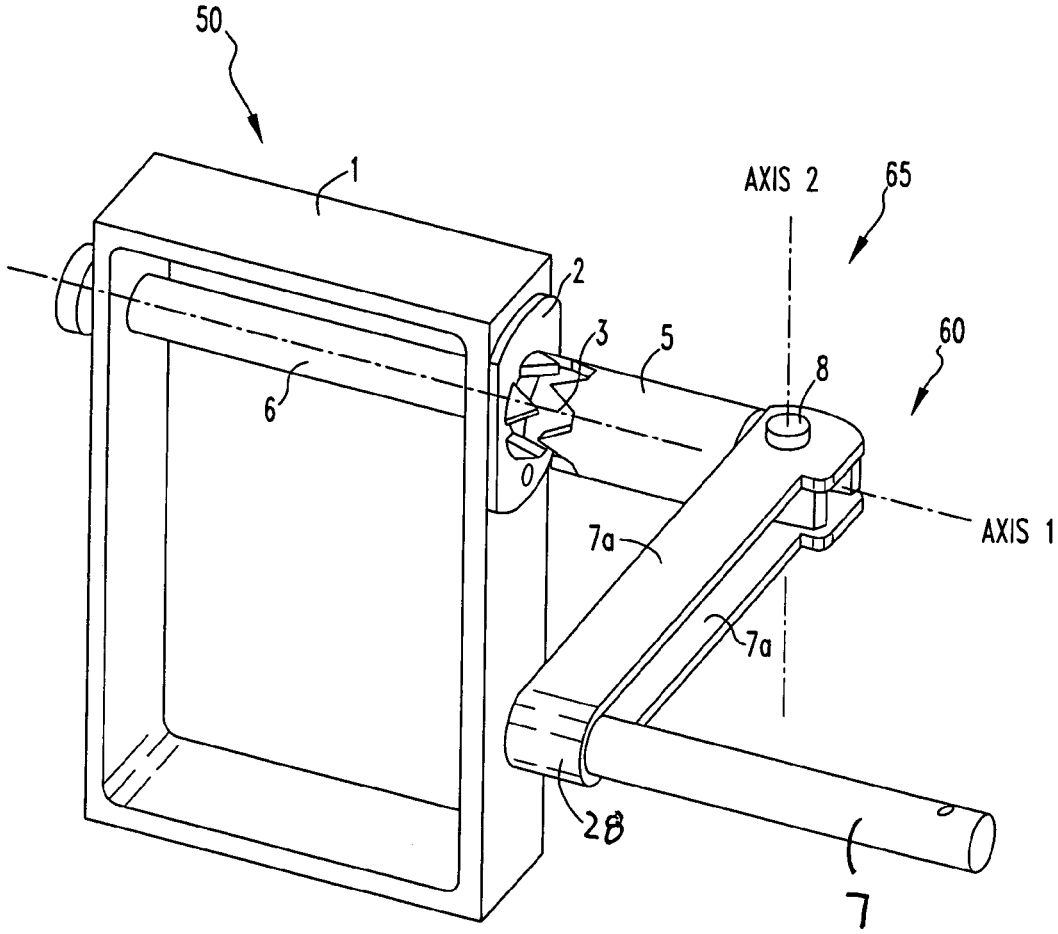
FIG. 1 shows part of the upper shackle assembly of a pump jack.

Referring now to the drawings wherein like reference numerals refer to similar or identical parts throughout the several views, and more specifically to FIG. 1 thereof, there is shown an apparatus 50 for cranking a shackle 1 of a pump jack. The apparatus 50 comprises a shaft 6 which fits through the shackle 1. The apparatus comprises an arm rotatably attached to the shaft in proximity to a first end of an arm. The apparatus 50 comprises a handle 7 for cranking the shaft 6. The handle 7 having a locked state in which the handle 7 is unable to rotate the shaft 6, and an unlocked state in which the handle 7 is able to rotate the shaft 6. The handle attached to the arm in proximity to a second end of the arm. The handle extending essentially perpendicularly from the arm. The apparatus 50 comprises a locking mechanism 60 engaging the arm 28 at a pivot point 65 and the shaft 6. The locking mechanism 60 placing the handle 7 in the locked state or the unlocked state by moving the arm 28 about the pivot point 65 to a first position where the handle extends inward toward the shackle or a second position where the handle extends outward away from the shackle, respectively.

Figure 2:
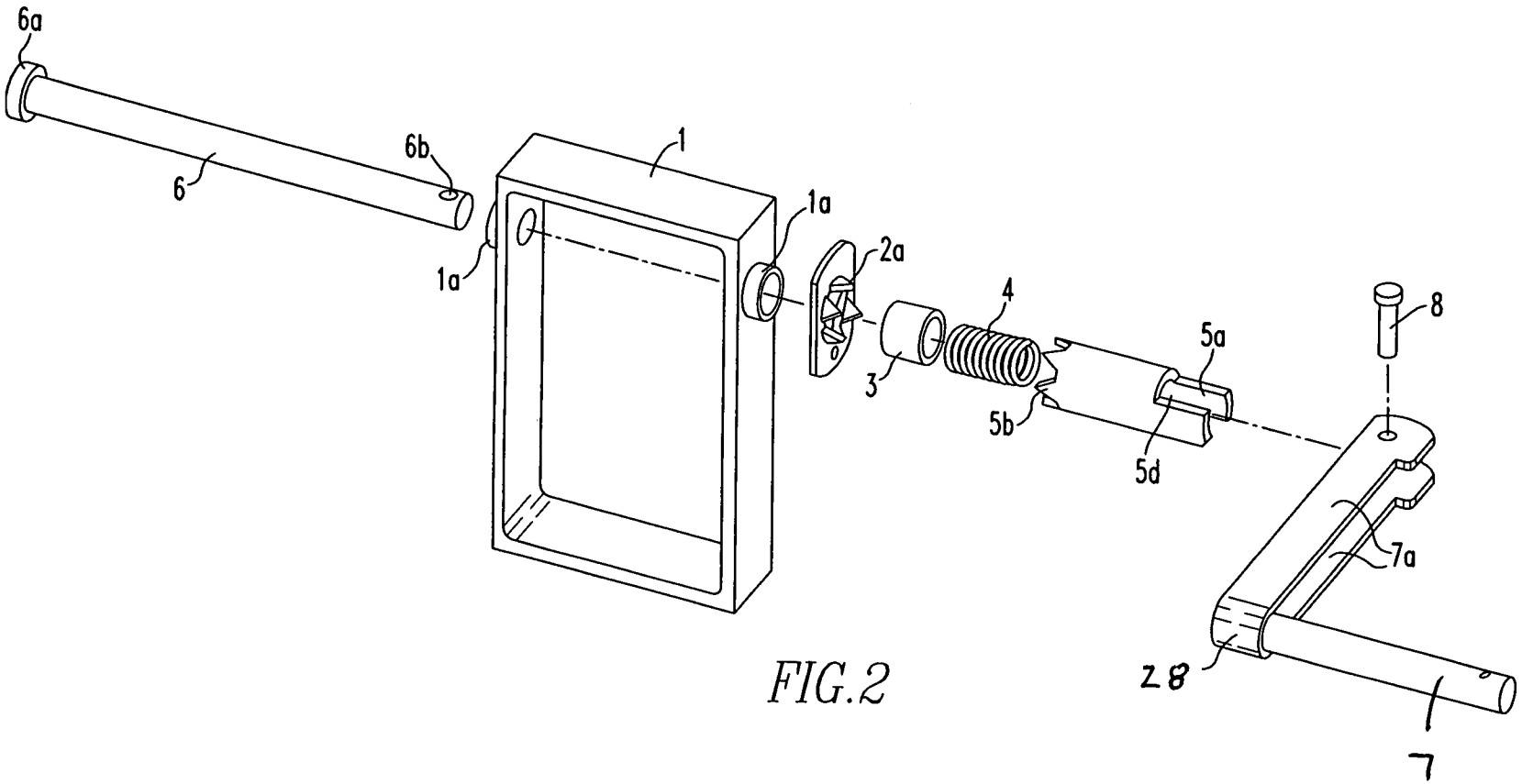
FIG. 2 is an exploded view of the assembly of FIG. 1.

The locking 60 mechanism preferably includes all or some of the elements shown in FIG. 2.

Preferably, the locking mechanism 60 includes a plate 2 having a plurality of teeth 2*a*, attached to the shackle 1. The locking mechanism 60 preferably includes a pin 8 which holds the arm 28 to the shaft, the pin 8 extending into the shaft and arm 28. Preferably, the locking mechanism 60 having an axis 1 corresponding to a long axis of the shaft, and an axis 2 which corresponds to a long axis of the pin 8. When the handle 7 is rotated about the axis 1, the handle 7 which is connected to the arm 28 which is connected to the shaft 6, causes the shaft 6 to rotate with the handle 7. When the handle 7 is turned about the axis 2, the shaft does not rotate.

The locking mechanism 60 preferably includes a spacer 3, a spring 4, and a collar 5 that are a sliding fit over the shaft. Preferably, the collar 5 has fingers 5*a*, and the arm 28 has two legs 7*a*, with the fingers 5*a* on the collar 5 fitting between the legs 7*a*. The collar 5 preferably slides axially on the shaft 6 but is constrained to rotate with the shaft 6 because of its engagement with the arm 28. Preferably, the collar 5 has teeth 5*b* on one end which are a same size and shape as the teeth 2*a* on the plate 2.

The locking mechanism 60 preferably includes bushings la attached on either side of the shackle 1. Preferably, the spring 4 exerts a force against the spacer 3 which in turn bears against one of the bushings la and the shackle 1. The spring 4 preferably exerts a force against an inner shoulder 5*c* inside outer shoulders 5*d* on the collar 5 in turn bear against the handle 7. Preferably, the spring 4 is held in compression and is prevented from forcing the shaft, collar 5, arm 28 and handle 7 away from the shackle 1 by a head 6*a* on the other end of the shaft.

The handle 7 preferably can be cranked freely about axis 1 to rotate the shaft through arm 28 to lower the pump jack, and the teeth of the plate 2 and the collar 5 do not touch each other because of the axial distance between the plate 2 and the collar 5. Preferably, the shaft is locked by the handle 7 being held rotationally relative to axis 1 and is turned about axis 2 of the pin 8. The camming surfaces 7*b* on the arm 28 push against the outer shoulders 5*d* on the collar 5, forcing the collar 5 to move axially to the left of the shaft against the spring 4 force. The axial motion of the collar 5 brings the teeth of the plate 2 and the collar 5 into engagement with each other.

The present invention pertains to a method for cranking a shackle 1 of a pump jack. The method comprises the steps of placing a handle 7 for cranking a shaft 6 that extends through the shackle 1 in an unlocked state where the handle extends outward away from the shackle by moving the handle 7 about a pivot point 65 from a locked state where a locking mechanism 60 engages an arm that extends from the shaft and the handle extends essentially perpendicularly from the arm and where the handle extends inward toward the shackle. There is the step of rotating the handle 7 about an axis of the shaft 6 to rotate the shaft 6.

In the operation of the invention, FIGS. 1, 2, and 3 all show the assembly in the unlocked position. In other words, when in the position shown, the crank can be rotated repeatedly about the Axis 1 in order to cause the work platform to be lowered.

FIG. 1 shows part of the upper shackle assembly of a pump jack. This assembly has been oriented so as to show the crank locking mechanism 60. FIG. 2 is an exploded view of this assembly. The steel shackle 1 has small bushings 1*a* permanently attached on either side through which passes the shaft 6. The shaft 6 has a head 6*a* on one end which bears against bushing 1*a*. The shaft 6 is able to rotate freely in the bushings.

A plate 2 having several teeth 2*a* is rigidly attached to one side of the shackle 1. It fits closely over the outside diameter of the bushing 1*a*. The plate 2 and its teeth 2*a* are effectively one piece with the shackle 1.

A spacer 3, a spring 4, and a collar 5 are a sliding fit over the shaft 6.

An arm 28 is held onto the end of the shaft 6 by a pin 8 which fits into the hole 6*b* in the shaft 6. Thus, the handle 7 when rotated about Axis 1 will cause the shaft 6 to rotate with it through the arm 28 which connects between the handle 7 and the shaft 6. But in addition, the arm 28 and thus the handle 7 may be turned about the Axis 2, which corresponds with the long axis of the pin 8, without rotating the shaft 6. The reason for this will be seen later.

The fingers 5*a* on the collar fit closely between the two legs 7*a* of the arm 28 so the collar 5 may slide axially on the shaft 6 but is constrained to rotate with the shaft 6 because of its engagement with the arm 28. The collar has teeth 5*b* on one end which are the same size and shape as the teeth 2*a* on the plate.

Figure 3A:
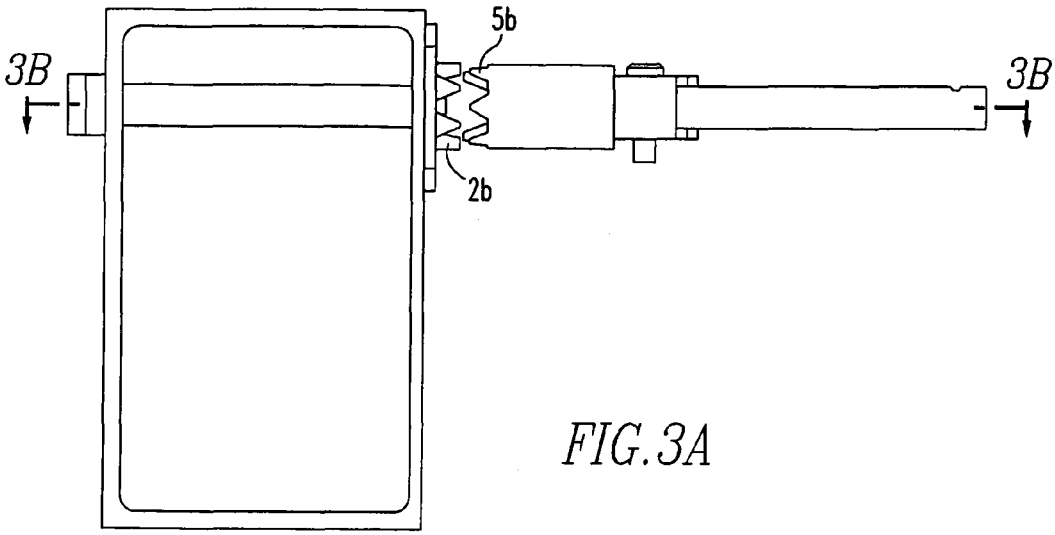
FIGS. 3*a* and 3*b* are cutaway views of the assembly of FIG. 1.
Figure 3B:
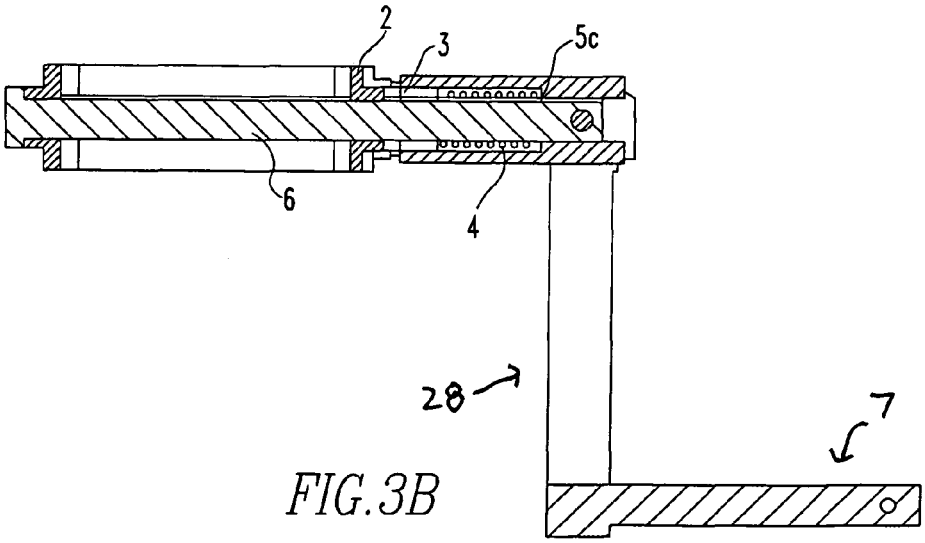

FIGS. 3*a* and 3*b* are cutaway views of the assembly. One end of the spring 4 exerts force against the spacer 3 which in turn bears against the bushing 1*a* and the shackle 1. The other end of the spring exerts force against an inner shoulder 5*c* inside the collar 5. The outer shoulders 5*d* on the collar in turn bear against the arm 28. The spring is held in compression and is prevented from forcing the shaft 6, collar 5, and arm 28 away from the shackle 1 by the head 6*a* on the other end of the shaft 6.

When all the parts are as shown in FIGS. 1, 2, and 3*a* and 3*b*, the handle 7 can be cranked freely about Axis 1 to rotate the shaft 6. This is the mode of operation when the user wishes to lower the work platform. Notice that the teeth 2*a* and 5*b* do not touch each other because of the axial distance between the plate 2 and the collar 5.

Figure 4:
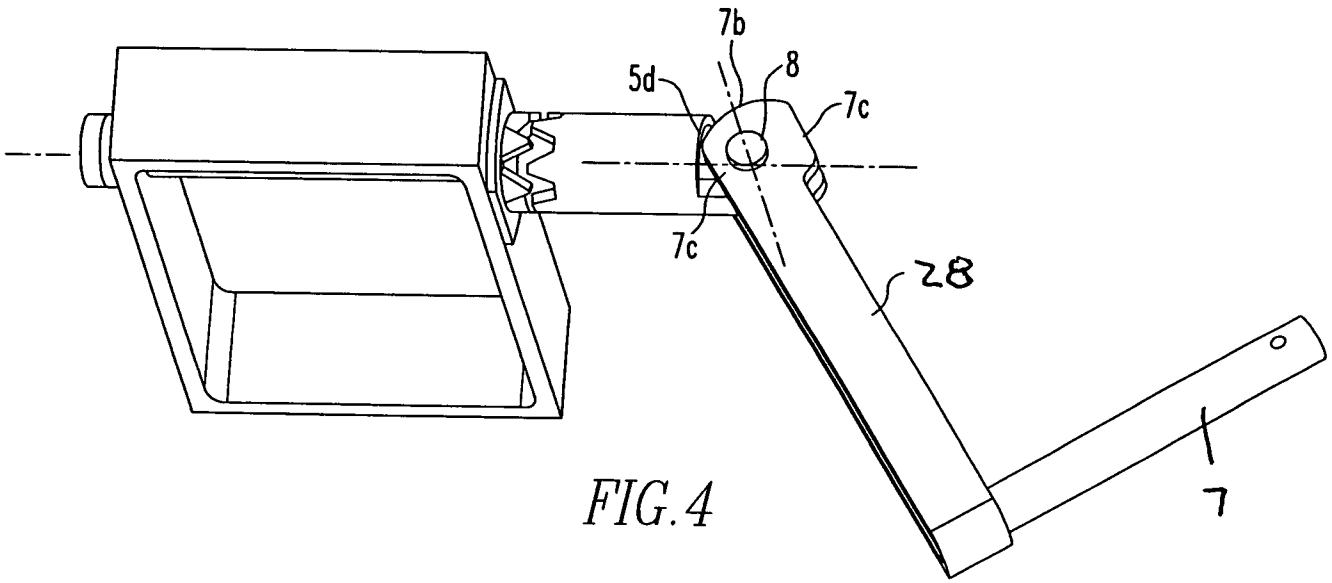
FIG. 4 shows the crank assembly in the process of being locked to prevent shaft rotation.
Figure 5:
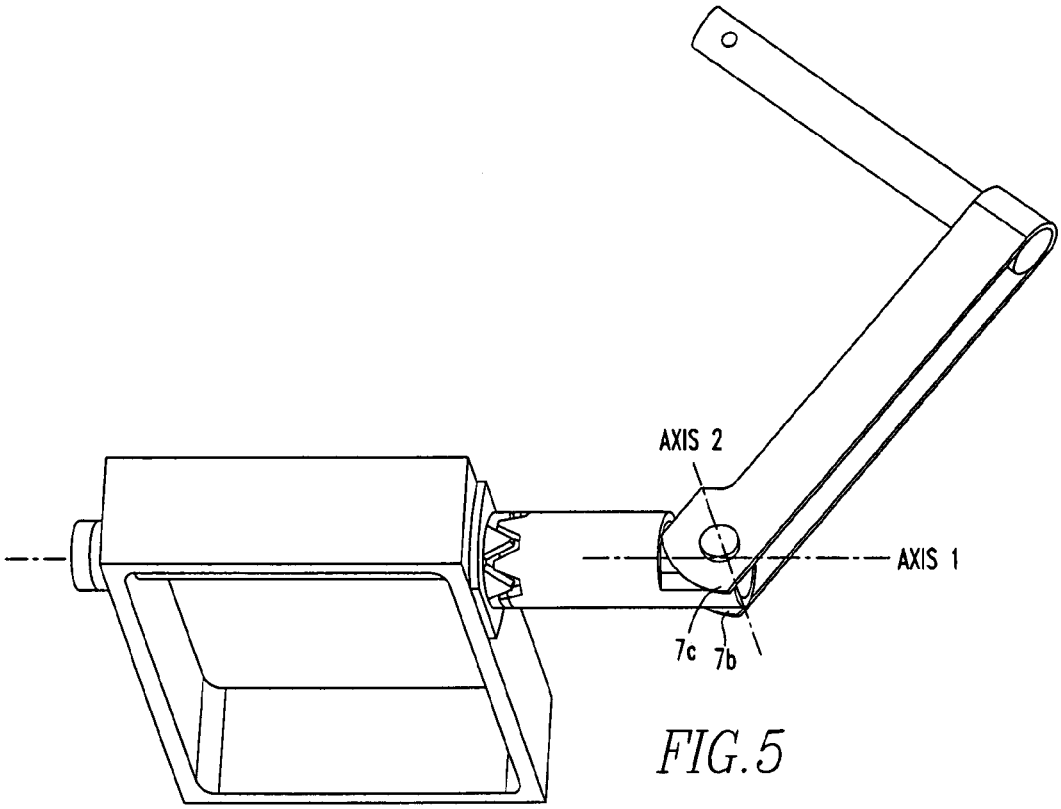
FIG. 5 shows the crank assembly in the process of being locked to prevent shaft rotation.

Now, for raising the work platform and when the platform is to remain stationary, the shaft 6 must be locked to prevent its rotation. FIGS. 4 and 5 show the crank assembly in the process of being locked to prevent shaft 6 rotation.

To lock, the handle 7 and arm 28 are held fixed rotationally relative to Axis 1 and are turned about Axis 2 of the pin 8 by arm 28 rotating about axis 2. The camming surfaces 7*b* on the arm 28 push against the outer shoulders 5*d* on the collar, forcing the collar to move axially to the left on the shaft 6 against the spring force. This axial motion of the collar brings teeth 2*a* and 5*b* into engagement with each other. Because the teeth are pointed, the teeth will come together even if they weren't perfectly aligned initially.

Figure 6:
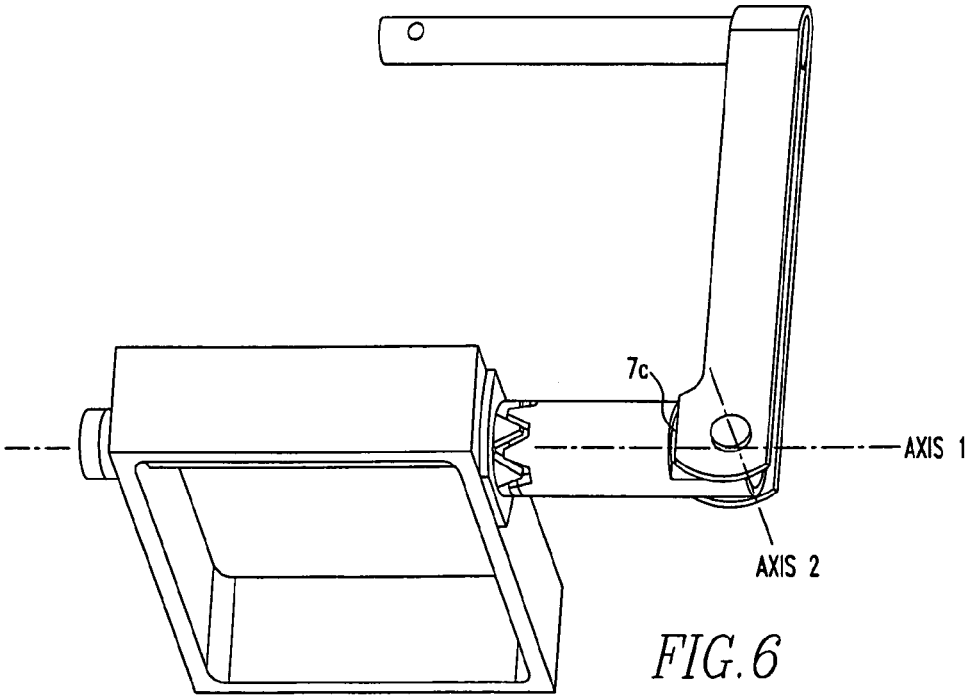
FIG. 6 shows the assembly of FIG. 1 in the fully locked position.

FIG. 6 shows the assembly in the fully locked position. Notice the handle 7 has turned 180 degrees about Axis 2. The shaft 6 is locked against rotation because the non rotating plate 2 has engaged the collar 5 (through their teeth) which in turn is rotationally coupled to the shaft 6 by way of the arm 28 and pin 8.

To unlock the shaft 6 in order to lower the work platform, the arm 28 and thus the handle 7 would first be turned about Axis 2 through 180 degrees back to the state shown in FIG. 1. During this turning the camming surfaces 7*b* on the arm 28 would "back away" from the outer shoulders 5*d* on the collar, allowing the spring to force the collar to the right, thus disengaging the teeth on the plate and collar. When the handle 7 is back as shown in FIG. 1 extending outwards away from the shackle, the arm 28 and the handle 7 can be rotated about Axis 1 again to turn the shaft 6 and lower the work platform where the arm 28 extends essentially perpendicularly from Axis 1 and handle 7 essentially in parallel with Axis 1 as they rotate about Axis 1.

Notice that the force of the spring tends to hold the arm 28 and the handle 7 in either the locked or unlocked position (FIG. 1 and FIG. 6) because of the flats 7*c* at the ends of the camming surfaces 7*b* on the arm 28.

It should be understood that the handle 7 does not need to be exactly in the position shown in FIG. 1 before the handle 7 can be turned about Axis 2 to lock. In FIG. 1, arm 28 is seen to be in the 9 o'clock position relative to the shackle 1, the Axis 1 being perpendicular to the "face" of the "clock". When locked, it has turned about Axis 2 to the 3 o'clock position. In fact, the arm 28 could've been at 12 o'clock before locking and 6 o'clock after, or any combination. The plurality of teeth and their pointed shape guarantee engagement will occur regardless of the arm's 28 rotational position relative to Axis 1 prior to locking.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An apparatus for cranking a shackle of a pump jack comprising:

a shaft which fits through the shackle of the pump jack;

an arm rotatably attached to the shaft;

a handle for cranking the shaft, the handle having a locked state in which the handle is unable to rotate the shaft, and an unlocked state in which the handle is able to rotate the shaft, the handle attached to the arm; and a locking mechanism engaging the arm at a pivot point and the shaft, the locking mechanism placing the handle in the locked state or the unlocked state by moving the handle about the pivot point to a first position or a second position, respectively, the locking mechanism includes a pin which holds the arm to the shaft, the pin extending into the shaft and arm, the locking mechanism having a first axis corresponding to a long axis of the shaft, and a second axis which corresponds to a long axis of the pin, when the handle is rotated about the first axis, the handle causes the shaft to rotate with the handle, when the handle is turned about the second axis, the shaft does not rotate, the locking mechanism includes a spacer, a spring, and a collar that are a sliding fit over the shaft, the collar has fingers, and the arm has two legs, with the fingers on the collar fitting between the legs.

2. An apparatus as described in claim 1 wherein the collar slides axially on the shaft but is constrained to rotate with the shaft because of its engagement with the arm.

3. An apparatus as described in claim 2 wherein the collar has teeth on one end which are a same size and shape as the teeth on the plate.

4. An apparatus as described in claim 3 wherein the locking mechanism includes bushings attached on either side of the shackle.

5. An apparatus as described in claim 4 wherein a spring exerts a force against the spacer which in turn bears against one of the bushings and the shackle.

6. An apparatus as described in claim 5 wherein the spring exerts a force against an inner shoulder inside outer shoulders on the collar in turn bear against the arm.

7. An apparatus as described in claim 6 wherein the spring is held in compression and is prevented from forcing the shaft, collar and arm away from the shackle by a head on the other end of the shaft.

8. An apparatus as described in claim 7 wherein the handle can be cranked freely about the first axis to rotate the shaft to lower the pump jack, and the teeth of the plate and the collar do not touch each other because of the axial distance between the plate and the collar.

9. An apparatus as described in claim 8 wherein the arm has camming surfaces and the shaft is locked by the handle being held rotationally relative to the first axis and is turned about the second axis of the pin, the camming surfaces on the arm push against the outer shoulders on the collar, forcing the collar to move axially to the left of the shaft against the spring force, the axial motion of the collar brings the teeth of the plate and the collar into engagement with each other.

* * * * *